United States Patent [19]

Archer et al.

[11] Patent Number: 4,969,408

[45] Date of Patent: Nov. 13, 1990

[54] SYSTEM FOR OPTIMIZING TOTAL AIR FLOW IN COAL-FIRED BOILERS

[75] Inventors: David H. Archer, Pittsburgh; M. Mushtaq Ahmed, Turtle Creek, both of Pa.

[73] Assignee: Westinghouse Electric Corp., Pittsburgh, Pa.

[21] Appl. No.: 440,138

[22] Filed: Nov. 22, 1989

[51] Int. Cl.[5] ..... F23D 1/00; F23B 7/00; G01B 11/00; G05B 13/04

[52] U.S. Cl. ..... 110/347; 110/147; 110/186; 110/343; 122/22; 364/510; 364/551.01; 364/149

[58] Field of Search ..... 364/431.01, 550, 551.01, 364/510, 148-150, 152; 110/104 R, 147, 185, 186, 343, 245, 347; 122/449, 4 D, 22; 60/662, 683; 431/76

[56] References Cited

U.S. PATENT DOCUMENTS

| | | | |
|---|---|---|---|
| 4,315,730 | 2/1982 | Watson | 431/76 |
| 4,430,963 | 2/1984 | Finet | 122/449 |
| 4,552,098 | 11/1985 | Wynnyckyj et al. | 110/185 X |
| 4,575,334 | 3/1986 | Keyes, IV et al. | 431/76 |
| 4,621,583 | 11/1986 | Kaski | 122/449 X |
| 4,622,922 | 11/1986 | Miyagaki et al. | 122/449 |
| 4,676,734 | 6/1987 | Foley | 110/186 X |
| 4,685,072 | 8/1987 | Johnson et al. | 364/551.01 |
| 4,846,081 | 7/1989 | Homer et al. | 110/186 |

OTHER PUBLICATIONS

"On-Line Elemental Analyzer for Bulk Material", GAMMA-METRICS, 1987.

*Primary Examiner*—Lall: Parshotam S.
*Assistant Examiner*—Edward Pipala

[57] ABSTRACT

A system for monitoring combustion of coal in a boiler detects coal composition and heating value using a bulk material analyzer and determines an air/fuel mixture so that when the coal is burned oxygen is available throughout the boiler and the wall temperature of the boiler is maintained below the metallurgical limit and the surface temperature below the ash fusion temperature of the coal where slagging is not desired. The temperature and pressure of steam in the boiler, fuel and air flow rates and temperature and oxygen content of the stack gases are supplied to a boiler model. The boiler model predicts how varying the air supply rate affects sensible heat loss. Periodic measurements of unburned carbon in the ash produced by combustion of the coal are correlated with the operation of the boiler at the time that the ash was produced to provide a basis for estimating unburned coal loss. An optimum air/fuel mixture is determined to minimize heat loss for a given steam production rate or to maximize steam production, using the estimate of unburned carbon loss and output from the boiler model, while at all times maintaining sufficient air flow to prevent oxygen depletion and acceptable wall temperatures.

12 Claims, 3 Drawing Sheets

SYSTEM FOR OPTIMIZING TOTAL AIR FLOW IN COAL-FIRED BOILERS

BACKGROUND OF THE INVENTION

1. Field of the Invention

The present invention is related to the operation of a coal-fired boiler and, more particularly, to optimizing air flow in a coal-fired boiler to minimize heat loss or maximize steam production without causing ash fusion or oxygen depletion in the boiler.

2. Description of the Related Art

Many techniques are known for controlling combustion of fuel to meet predetermined criteria. With respect to coal-fired boilers, such as those used in electricity power generating plants, boiler operation is commonly studied using computerized models. For example, EIS Systems Group of EI International, Inc. in Idaho Falls, Id. markets a product known as PEPSE which can be used for modeling boiler operation. However, there is no known system which operates on-line in real time and takes into account variations in the heating value, elemental composition and ash content of coal supplied to the boiler and uses a boiler model to control operation of the boiler in response to each variation in coal composition, ash content, heating value and the actual operating conditions of the boiler.

SUMMARY OF THE INVENTION

An object of the present invention is to minimize heat loss while maintaining a given rate of steam production from a coal-fired boiler.

Another object of the present invention is to maximize steam production from a given amount of coal without causing ash fusion or attack of metal surfaces by partially burned combustion product gases in a coal-fired boiler.

Yet another object of the present invention is to minimize unburned carbon content in the ash from a coal-fired boiler.

The above objects are attained by providing a method of monitoring combustion of fuel using a computer, comprising the steps of detecting characteristics of the fuel supplied and determining an air/fuel mixture resulting in one of minimal heat loss and maximum steam production while meeting operational criteria. The operational criteria may include maintaining sufficient levels of oxygen in critical regions of the boiler, maintaining the boiler tube temperatures below metallurgical limits and surface temperatures below the fusion temperature of the ash and minimizing unburned carbon in the ash. Preferably, the characteristics of the fuel are determined by continuously analyzing the fuel, using a bulk material analyzer for coal to determine coal and ash composition and heating value of the coal.

When the method is applied to a coal-fired boiler, the method preferably includes modeling boiler performance in dependence upon steam temperature and pressure, air and coal supply rates, coal composition and heating value of the coal. These parameters are preferably measured continuously during operation of the boiler. In addition, the ash is periodically or continuously sampled to determine unburned carbon content. Between the sampling periods, the unburned carbon content is estimated by correlating the measured carbon content with the operating conditions that produced the ash which was sampled.

These objects, together with other objects and advantages which will be subsequently apparent reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENT

Figure 1:
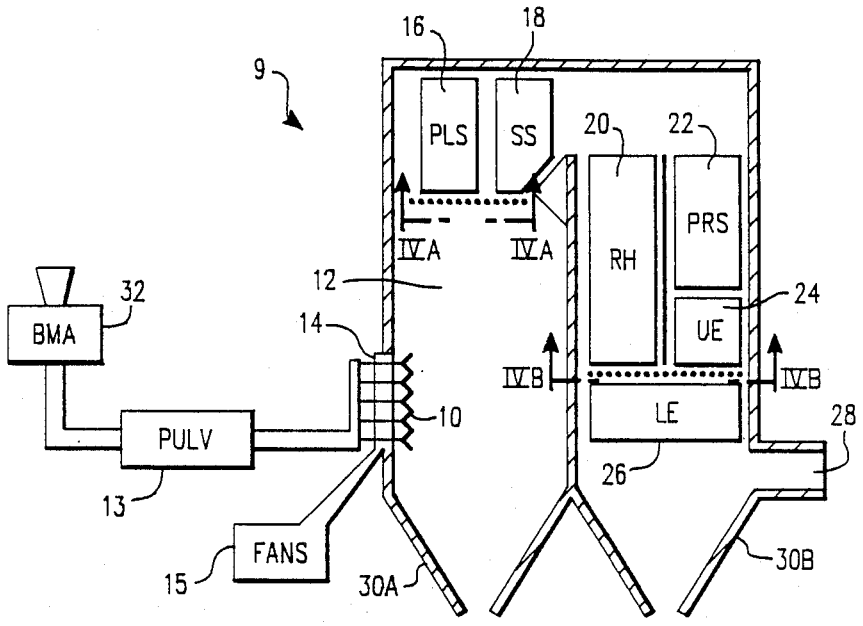
FIG. 1 is a block diagram of a coal-fired boiler.

A block diagram of a coal-fired boiler 9 is illustrated in FIG. 1. Coal is supplied to burners 10 in the furnace section 12 of the boiler 9. In a typical coal-fired boiler used at an electricity power generating plant, the coal is pulverized in a pulverizer 13 and transported to the burners by what is termed primary air flow, using 1 to 2 pounds of air per pound of coal. Secondary air is supplied to the furnace 12 by air inlet 14. Typically, 8 to 9 pounds of secondary air is added. The amount of secondary air added can be adjusted by controlling the speed and number of fans 15 or by adjusting inlet guide vanes of the fans 15 which supply the secondary air to the furnace 12.

The stack gas produced by burning the coal passes through the platen superheater (PLS) 16, secondary superheater (SS) 18, reheater (RH) 20, primary superheater (PRS) 22, upper economizer (UE) 24 and lower economizer (LE) 26, before exiting via a flue 28. Ash produced by burning the coal 10 is discharged from the boiler 9 at various locations including hoppers 30A and 30B and from devices such as an electrostatic precipitator, a baghouse, or a cyclone (all not shown) connected to the flue 28 downstream from the boiler 9.

According to the present invention, coal or other fuel supplied for combustion is analyzed to detect characteristics, such as coal and ash composition and heating value. In the embodiment illustrated in FIG. 1, a bulk material analyzer (BMA) 32 is used for this purpose. Bulk material analyzers are available from Gammametrics, Inc. of San Diego, Calif. A BMA is able to provide an analysis of the elemental composition and the moisture content of material passing through the BMA and can include the ability to calculate the ultimate analysis, the elemental ash analysis and the heating value from this analysis. In addition, ash softening and the melting temperatures can be predicted from the ash composition. This detailed information on the fuel supplied to the boiler 9 enables the boiler 9 to be operated optimally by adjusting the air/fuel mixture. Typically, to adjust the air/fuel mixture, the rate of coal supply and primary air flow rate remain fixed and the secondary air flow rate is adjusted.

Figure 2:
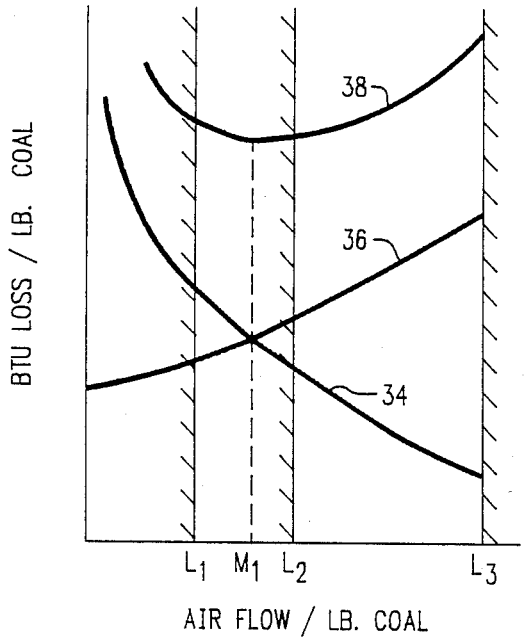
FIG. 2 is a graphical representation of BTU loss per pound of coal versus air flow.

The objective is to achieve a desired or maximum steam production rate while minimizing energy loss and avoiding ash deposition and corrosion of the boiler. Too little air results in incomplete combustion of coal resulting in unburned carbon in the ash and possibly CO and unburned hydrocarbons in the stack gases. This situation is represented in the graph illustrated in FIG. 2 by curve 34 which has a negative slope indicating large amounts of unburned fuel at low air flow rates and low amounts of unburned fuel at high air flow rates. Too much air results in excessive energy loss from the boiler 9 due to the sensible heat of the stack gases. This situation is represented by curve 36 in FIG. 2 which has a positive slope indicating increased sensible heat loss at higher air flows. Excessive air also results in decreased temperatures and significantly reduced heat transfer rates in the furnace and radiant sections. The total heat loss is represented in FIG. 2 by curve 38 which has a minimum corresponding to an amount of air flow $M_1$.

Figure 3:
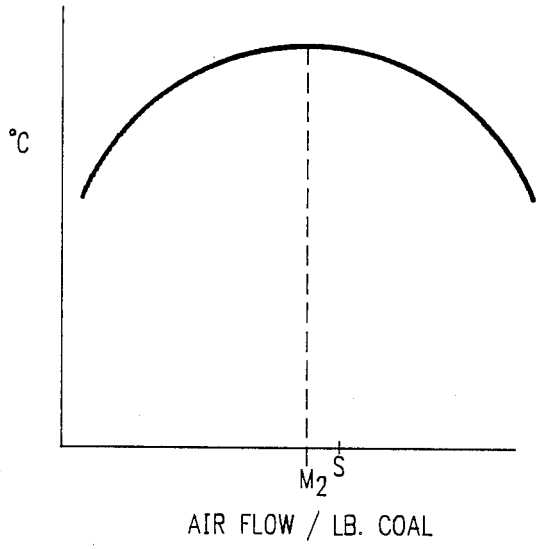
FIG. 3 is a graphical representation of the maximum combustion product gas temperature versus the air flow for a constant fuel flow.

Corrosion/oxidation of boiler tubes, particularly in the platen superheater 16 and secondary superheater 18 and the sintering and melting of ash deposits in the furnace and radiant boiler sections are the result of high temperatures in the product gases produced by combustion of the coal. The effect of air flow on product gas temperature is illustrated in FIG. 3. The temperature maximum occurs at an air flow represented by $M_2$ which is just slightly less than the point S where complete combustion of the fuel occurs. Air flow rates higher than point S thus reduce the stack gas temperature and avoids tube deterioration and ash deposits.

Figure 4A:
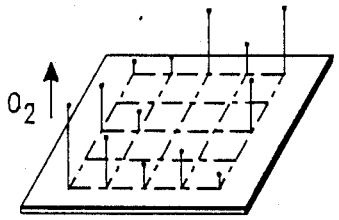
FIGS. 4A and 4B are graphical representations of oxygen concentration at different locations in the coal-fired boiler 9 illustrated in FIG. 1.

However, the temperature in the boiler 9 is not uniform even at a cross-section taken perpendicular to the flow of the stack gases. For example, one of the highest temperature regions in the boiler 9 illustrated in FIG. 1 is located near the dashed section IVA—IVA. Thus, ash deposition is most likely to occur near this cross-section and low oxygen concentrations are most likely to first occur in the surrounding region of the furnace 12. An example of variation in oxygen concentration in a cross-section taken over IVA—IVA is illustrated in FIG. 4A. As is apparent from FIG. 4A, while there is excess oxygen in the air passing through this region, there may be localized areas of depleted oxygen where chemically reducing attack can occur causing corrosion of the boiler tubes.

Figure 4B:
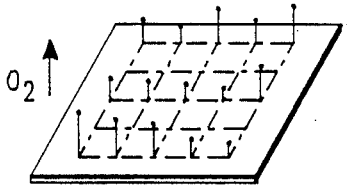

Due to the high temperatures in the region of greatest concern, oxygen concentration is preferably detected at a cooler location, such as that indicated by section IVB—IVB. An example of oxygen concentration at this location is illustrated in FIG. 4B. The oxygen concentrations illustrated in FIG. 4B relate to the oxygen concentrations illustrated in FIG. 4A. Methods for estimating the oxygen concentrations in the region illustrated in FIG. 4A from the oxygen concentrations at the region illustrated in FIG. 4B are known in the art. These methods are based upon known effects of geometry of the boiler on the gas flow and mixing and also utilize tests in which the amount of fuel supplied to individual burners is varied and the resulting effect on oxygen concentration is detected.

Figure 5:
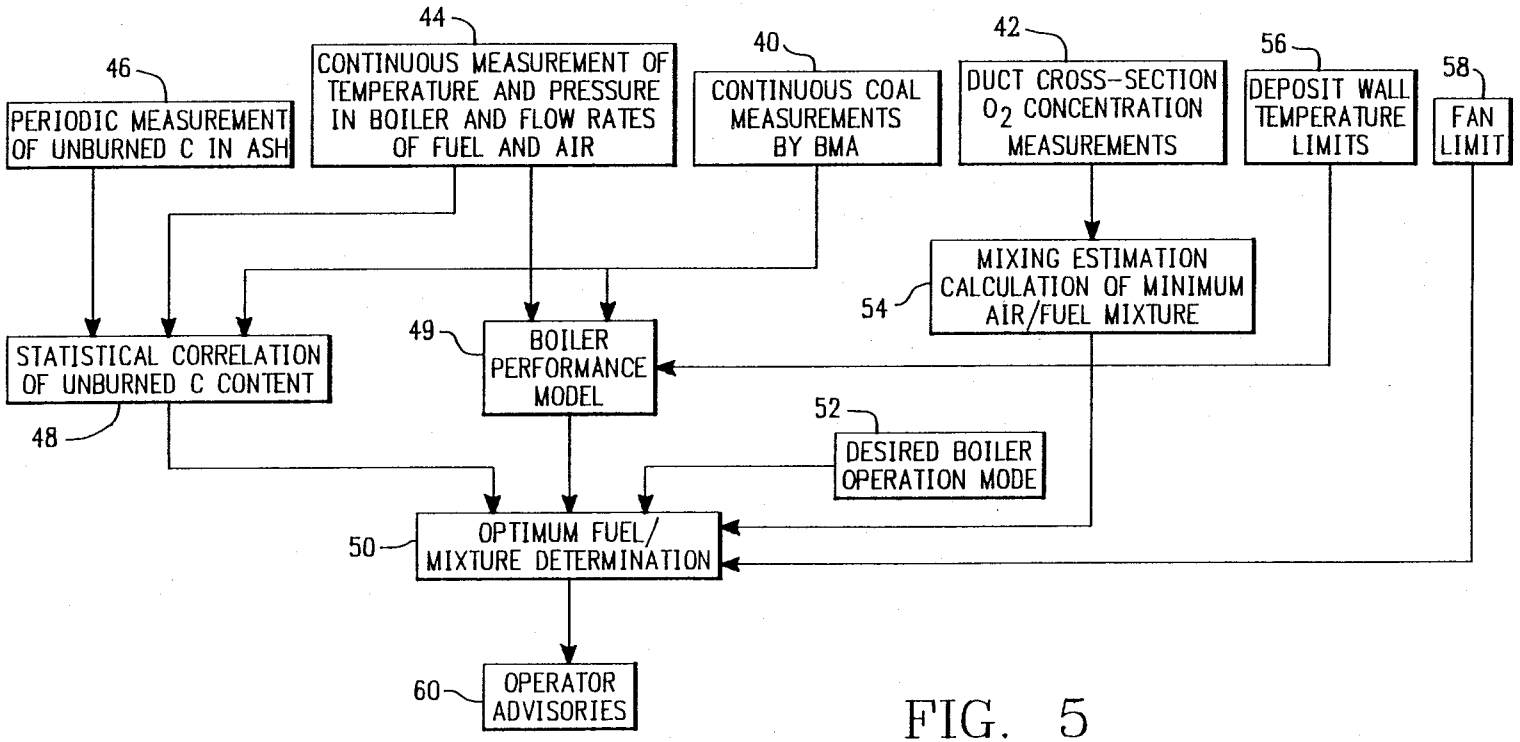
FIG. 5 is a block diagram of a system according to the present invention.

The relationships between gas flow, heat loss and detrimental effects on the boiler are applied in a method according to the present invention to determine an optimal air/fuel mixture. A block diagram of a method according to the present in invention is illustrated in FIG. 5. As described above, coal is continuously measured 40 by the BMA 32 and oxygen concentration is measured 42 across a duct cross-section. In addition, there is continuous measurement 44 of physical properties of the apparatus, such as flow, temperature and pressure of steam in the boiler 9 and rates of air and fuel supplied to the boiler 9. These measurements are made by conventional monitoring equipment typically provided for coal-fired boilers. In addition, the ash is continuously or periodically sampled 46 to measure unburned carbon content of the ash. Such sampling may occur daily or more frequently as changes occur in the coal supply or operating conditions of the boiler.

The data from these measurements are supplied to a processing unit represented by blocks 48–50 in FIG. 5. The periodic unburned fuel measurements 46 are correlated 48 with the measurements 40, 44 of coal composition and boiler operation made at the time that the sampled ash was produced. The measurements 40, 44 of coal composition, heating value, and boiler operating conditions are used for modeling 49 boiler performance, using, e.g., PEPSE code, to predict sensible heat loss. From the estimates of unburned fuel content and sensible heat loss, an optimum air/fuel mixture is determined 50 as described below.

Other inputs to the optimum air/fuel mixture determination 50 include desired operating conditions or mode 52. Among the modes of operation which might be selected by an operator include achieving a fixed steam production rate for which sensible heat loss and unburned fuel should be minimized and maximizing steam production while avoiding ash deposition and tube corrosion.

As noted above, the air/fuel mixture should not be determined solely to minimize heat loss or maximize steam production. According to the present invention, the oxygen concentrations measured 42, e.g., in the radiant section of the boiler 9 near the lower economizer 26, is used as input for estimating 54 the minimum air/fuel ratio which will prevent localized oxygen depletion in the furnace 12. Also, the boiler performance model 49 determines the ash fusion temperature from a deposit wall temperature limit input 56 as part of the operating characteristics of the boiler 9.

The effects of these limits are illustrated in FIG. 2. To maintain the requisite concentration of oxygen in the stack gases, the air flow must be maintained at e.g., a rate $L_1$ illustrated in FIG. 2. However, assuming the points $M_1$ and $M_2$ (FIG. 3) represent roughly the same rate of air flow, the minimum rate of air flow required to prevent excessive temperatures which would cause ash deposition might be $L_2$. When both ash deposition and reducing conditions are avoided by the air flow rate $L_1$, the air flow rate $M_1$ may be used to minimize sensible heat loss. On the other hand, when ash deposition or reducing conditions occur below the air flow rate $L_2$, the air flow must be maintained slightly above the rate $L_2$, even though there is a greater amount of sensible heat loss than occurs at the air flow rate $M_1$.

Other limits on air flow rate also exist due to maximum capacity of pulverizers, pumps, etc. For example, there is a maximum limit on the rate of air supply based upon the output of fans which, as described above, supply the secondary air. This is represented by a fan limit 58 in FIG. 5 which is supplied as an input to the determination 50 of the optimum air/fuel mixture. In FIG. 2, this limit is represented by an air flow rate $L_3$. Thus, when the operation mode selected is to maximize steam production, the air flow rate determined 50 may be approximately $L_3$.

The determination 50 of the optimum air/fuel mixture in dependence upon the desired boiler 9 operation and limits in the physical characteristics of the boiler 9 is output in operator advisories 60, as illustrated in FIG. 5. Alternatively, a system according to the present invention may directly control the air/fuel mixture while reporting to a human operator when the mixture is changed.

There are existing computer programs capable of modeling 49 boiler performance. One way of estimating 48 unburned carbon content or determining 50 the optimum/fuel mixture is to use an expert system. This allows the complex decision-making process to be accomplished using the same code for all boiler installations while the limits and other data which varies from boiler to boiler are converted into non-dimensional values, e.g., high, low, very high, very low, etc., in input routines using data which is unique for each boiler.

The many features and advantages of the present invention are apparent from the detailed specification and, thus it is intended for the appended claims to cover all such features and advantages of the system which fall within the true spirit and scope of the invention. Further, since numerous modifications and changes will readily occur to those skilled in the art, it is not desired to limit the invention to the exact construction and operation illustrated and described. For example, the invention is not limited to applications where coal is used as the fuel or where the fuel is used to heat a boiler 9. Accordingly, all suitable modifications and equivalents may be resorted to falling within the scope and spirit of the invention.

What is claimed is:

1. A method of using a computer to monitor combustion of fuel to heat a fluid in a boiler, said method comprising the steps of:

(a) detecting characteristics of the fuel supplied;

(b) measuring physical properties of the apparatus, by performing the following substeps:

(b2) measuring flow, temperature and pressure of the fluid in the boiler; and (b2) detecting stack gas temperature; and (c) determining an air/fuel mixture resulting in at least one of minimal heat loss and maximum production, while meeting operational criteria, said determining including the following substeps:

(c1) measuring rates of air and fuel supplied;

(c2) comparing the flow, temperature and pressure measured in step (b1) with a desired steam output; and (c3) determining the air/fuel mixture for optimized operation, including the factors of (c3i) minimizing heat loss in the stack gases; and (c3ii) preventing deterioration of the boiler while maintaining the desired steam output.

2. A method as recited in claim 1, wherein said determining in substep (c3) further comprises the factor of (c3iii) determining the air/fuel mixture to minimize unburned fuel in solid byproducts of the combination of the fuel.

3. A method as recited in claim 1, wherein the combustion of the fuel forms ashes having an ash fusion temperature, wherein said measuring in step (b) further includes the substep of (b3) detecting at least one of wall and surrounding surface temperatures of the boiler, wherein said comparing in step (c2) includes comparing the surrounding surface temperature with the ash fusion temperature, and wherein said determining in step (c3) comprises the factor of (c3iii) determining the air/fuel mixture to maintain tube wall temperature below a metallurgical limit selected to minimize corrosion/oxidation, and the surrounding surface temperature below the ash fusion temperature.

4. A method as recited in claim 1, wherein the combustion occurs at a first location, wherein said measuring in step (b) further includes the substep of (b3) measuring a first oxygen concentration at a second location different from the first location, and wherein said determining in step (c) further comprises the substeps of:

(c4) estimating a second oxygen concentration at a third location different from the second location; and (c5) determining a rate of air flow to maintain the second oxygen concentration at a predetermined level.

5. A method as recited in claim 4, wherein the boiler has a super heater section and a reheater section, wherein step (b3) comprises measuring the first oxygen concentration downstream from the reheater section, and wherein step (c4) comprises estimating the second oxygen concentration upstream from the superheater section.

6. A method as recited in claim 5, wherein a plurality of oxygen concentrations are measured and estimated at the second and third locations, respectively, to provide a cross section of oxygen concentration at the third location.

7. A method of using a computer to monitor combustion of coal to heat a boiler and produce steam, stack gases and ash, comprising the steps of:

(a) continuously analyzing at least samples of the coal, using a bulk material analyzer to determine coal composition, during supply thereof;

(b) calculating a heating value of the coal in dependence upon aid analyzing;

(c) determining desired operating conditions by selecting a mode of operation from among at least minimizing the heat loss in the stack gases for a given steam production rate and maximizing steam production;

(d) measuring steam flow, temperature and pressure in the boiler, air and coal supply rates, wall and surface temperatures of the boiler and oxygen concentration in the stack gases;

(e) modeling boiler performance in dependence upon the steam flow, temperature and pressure, the air and coal supply rates, the coal composition and the heating value of the coal to predict heat loss in the stack gases;

(f) determining an air/fuel mixture capable of maintaining the desired operating conditions, in dependence upon said modeling in step (e), to prevent boiler tube deterioration due to deficient amounts of oxygen and high wall temperatures and ash deposition due to excessive surface temperature, for the mode of operation selected in step (c).

8. A method as recited in claim 7, further comprising the steps of:

(g) periodically sampling the ash to determine unburned carbon content therein; and (h) estimating the unburned carbon content between periods of said sampling in step (g), and wherein said determining of the air/fuel mixture in step (f) includes minimization of the unburned coal content.

9. A system for monitoring combustion of coal in a boiler, comprising:

a bulk material analyzer for analyzing the coal as it is supplied to the boiler to determine coal composition, ash content and heating value of the coal;

measurement means for measuring steam flow, temperature and pressure in the boiler, air and coal supply rates, wall temperature of the boiler and oxygen concentration in the stack gases;

input means for inputting periodic measurements of unburned coal in ash produced by the combustion of the coal and a mode of operation selected from among at least a fixed steam production rate and maximum steam production;

processing means for modeling boiler performance in dependence upon the steam flow, temperature and pressure, the air and coal supply rates, the coal composition and the heating value of the coal to determine heat loss in the stack gases, for estimating unburned carbon content in the ash between the periodic measurements and for determining an air/fuel mixture in dependence upon the mode of operation, the modeling of boiler performance and the estimating of unburned carbon content.

10. A system as recited in claim 9, wherein the fuel/air mixture is selected by said processing means to maintain the oxygen content in the stack gases throughout the boiler above a predetermined level in accordance with the modeling of boiler performance and to maintain the wall temperature below a metallurigcal limit and the surface temperature of the boiler below the ash fusion temperature of the coal.

11. A system as recited in claim 10, wherein said measurement means comprises a plurality of oxygen sensors distributed across a first cross section of the boiler, and wherein said processing means includes means for estimating oxygen concentration at a second cross section of the boiler in dependence upon geometry of the boiler and gas flow and mixing.

12. A system as recited in claim 1, wherein the boiler has superheater and reheater sections, and wherein the first cross section is downstream from the reheater section of the boiler and the second cross section is upstream from the superheater section of the boiler.

* * * * *